US005287807A

United States Patent [19]

Johnston

[11] Patent Number: 5,287,807

[45] Date of Patent: Feb. 22, 1994

[54] PERSONAL CHECK AMOUNT STAMPING DEVICE

[76] Inventor: James R. Johnston, #36-455 S. Buckmoore Ave., Lake Wales, Fla. 33833-2701

[21] Appl. No.: 946,085

[22] Filed: Sep. 17, 1992

[51] Int. Cl.[5] ..... B41K 1/42

[52] U.S. Cl. ..... 101/333; 101/334

[58] Field of Search ..... 400/88; 101/333, 334, 101/405; 235/487, 494; 364/408, 406, 705.02

[56] References Cited

U.S. PATENT DOCUMENTS 3,363,548 1/1968 Aijima ..... 101/333
3,783,786 1/1974 Ellison et al. ..... 101/333
4,013,007 3/1977 Flynn ..... 101/333
4,455,100 6/1984 Bauer ..... 400/88
4,623,965 11/1986 Wing ..... 364/408
4,958,066 9/1990 Hedgcoth ..... 235/487

*Primary Examiner*—Edgar S. Burr
*Assistant Examiner*—Lynn D. Hendrickson

[57] ABSTRACT

A personal check amount stamping device for printing the exact amount of a check to be written on the face of the check form, in at least three locations. This printing of the exact amount by the writer of the check insures that the bank will not mis-interpret the amount of the check, and also obviates the job of printing the check amount on the bottom of the check by the bank employees.

2 Claims, 2 Drawing Sheets

PERSONAL CHECK AMOUNT STAMPING DEVICE

BACKGROUND OF INVENTION

This invention relates to an apparatus and method of printing on a check, personal, or commercial, the exact face amount for which a check is written, and the printing being in magnetic ink, of the type required by the bank, for reading by the computers in the individuals bank. This exact amount is printed in the "amount" space, in the face area of the check, and, on the right hand bottom space, reserved for the banks personnel to stamp this check face amount, for purposes of the computers in the bank to electronically read the amount, and record the transaction on all of the banks accounts involved.

It has been customary for a customer of a bank to write a check in longhand, write the face value amount in longhand, and also print the amount in numbers in a box at the right side of the check. Now when the check is received by the bank, it is not ready for the computers in the bank to handle the check electronically. A department of employees in the bank are charged with comparing the written face amount on the check with the written digits in the amount box on the check, and make a determination as to the correctness of the face value amount of the check, and, when this determination has been made, and any anomalies eliminated, the bank employee sets the amount on a special machine, containing magnetic types of ink, inserts the check in the machine, and the machine stamps the amount in the bottom right hand space on the check. After this amount has been stamped on the check, in the space allotted, the check can now be inputted into the computer, and the transaction recorded, and proper adjustments made to all accounts involved in the transaction.

The person who originally wrote the check has no knowledge of the actual transactions until receiving their monthly bank statement, and, sometimes, the amount has been misread, or, mis-stamped, and, much time, and effort is required by all concerned, to correct the mistake.

Several approaches have been provided for aiding the writer of the check to insure that the correct amount is deducted from their account during these transactions. Wing, in U.S. Pat. No. 4,623,965 teaches a microprocessor for writing a check, and this device having a printer included in its casing. The device of Wing has several drawbacks, in that it must receive a certain size check, the printer may, or may not be capable of using the required magnetic ink, the numbers may, or may not be readable by the computers in the bank, and, the printing device is not adaptable to changes in number preparation, required by different banks. Also, the check preparer would be charged with remembering any bank coding required to be associated with the check face amount being printed on the bottom right hand space on the check.

Another approach is taught in U.S. Pat. No. 4,958,066, wherein a check is pre-printed with various information, and some of the information being covered by removable opaque material, only readable when the Writers code has been revealed, by removing the opaque material from the desired code numbers. This approach is more concerned with ATM type transactions, and, having no printer, is not adaptable to check writing transactions.

Still another approach is taught in the art of Bauer, in U.S. Pat. No. 4,455,100, wherein an elaborate printing device is taught, and, upon setting up the body of the check, and the checks being stored on a roll, in the innards of the device, and, after meticulously setting up the body of the check, the device is closed by force, thereby printing a check, in a mosaic letter, and number design, The problem with this approach is again, the unadaptability of the device for the different number designs required in the different banks, and, the different types of ink required, this difference stemming from the different type readers being used by different banks.

SUMMARY OF THE INVENTION

Accordingly, it is an object of this invention to provide an apparatus and method of stamping the face amount of the check being written, as it is written, in three desired locations, in the space reserved for the check amount, on the line reserved for writing the check amount, and at the right hand bottom of the check form, thereby relieving the bank employees of the time consuming comparison operation, and also allowing the preparer of the check to stamp this same readable amount in the spaces allotted on the face of the check, thereby insuring the same amount in all three places on the face of the check.

It is another object of this invention to provide and apparatus which can be adapted to the requirements of the individual banks for character size, character shapes, and special ink types, thereby adapting to the computer reader requirements of individual banks.

Another object of this invention is to provide this check amount printer device to blank out any digits desired, such as in the check face amount space, but, to print any number identification and check face amount combination up to ten digits, or characters, in the bank identification space on the bottom right of the check form.

Another object of this invention is to allow the preparer of the check to print the same face amount in at least three places on the check form, in the actual check amount space, at the bottom right space, reserved for the bank employees to print the agreed upon amount, and at any other place on the check desired by the preparer Still another object of this invention is to have the check amount and any identifying information printed at the bottom right of the check form, in the correct print style, and, with the correct ink required by the bank.

Still another object of this invention is to provide this personal check amount stamp with a clip-on device, for attaching it to the personal check book, for continued use.

Yet another object of this invention is to provide a retractable reservoir of ink, in the form of an ink pad, or otherwise, at the bottom of the invention, to insure a fresh supply of ink for each stamping.

In carrying out this invention in the illustrative embodiment thereof, a personal check amount stamp device, having a set of ten digits, or characters, displayed in its frontal section, and these numbers each having a thumb wheel exposed through the viewing opening, for easy setting changes, is attached onto a personal check book by a retaining clip.

Now, when the check preparer wishes to write a check, they remove this device from the check book, and, using the appropriate thumb wheels, set the individual digits in the viewing opening of the device to the amount of the check to be written. The device having ten continuous number belts, and these belts, each being turnable on two supported free turning wheels, a top wheel, and a bottom wheel, in such a manner as to have the same number, or character, on the bottom, or stamping location of the bottom wheel, as is displayed in the viewing opening in the front of the device. A blank section of these number belts allows for setting the belt in a no-print setting, thusly allowing for less than ten digits to be printed.

Now, when the correct digits have been set in the viewing opening in the frontal section of the invention, the retractable ink pad on the bottom of the invention is retracted around to the backside of the invention, thereby exposing the set of digits, or characters to be printed, as was set in the viewing opening. As the exposed digits on the bottom of the invention have been freshly inked by the ink pad, and, as the invention is positioned over the correct location on the check form, a downward push on the spring loaded actuator prints the same digits, or characters, onto the surface of the check form.

Conveniently, the user may carry the invention at all times, clipped to their check book. When it is desired to write a check, the invention is un-clipped from the check book, the correct amount of the check set in the viewing window, the ink pad is retracted to its rearward position, and the invention is positioned over the correct location on the face of the check form, and the correct amount of the check is printed onto the check form in any location desired, especially in the face amount block, the written amount line, and at the bottom right location, used by the computers in the bank.

BRIEF DESCRIPTION OF THE DRAWINGS

This invention, together with other objects, features, aspects and advantages thereof, will be more clearly understood from the following description, considered in conjunction with the accompanying drawings Two sheets of drawings are furnished, sheet one contains FIG. 1, and FIG. 2, and sheet 2 contains FIG. 3.

DESCRIPTION OF THE PREFERRED EMBODIMENTS

Figure 1:
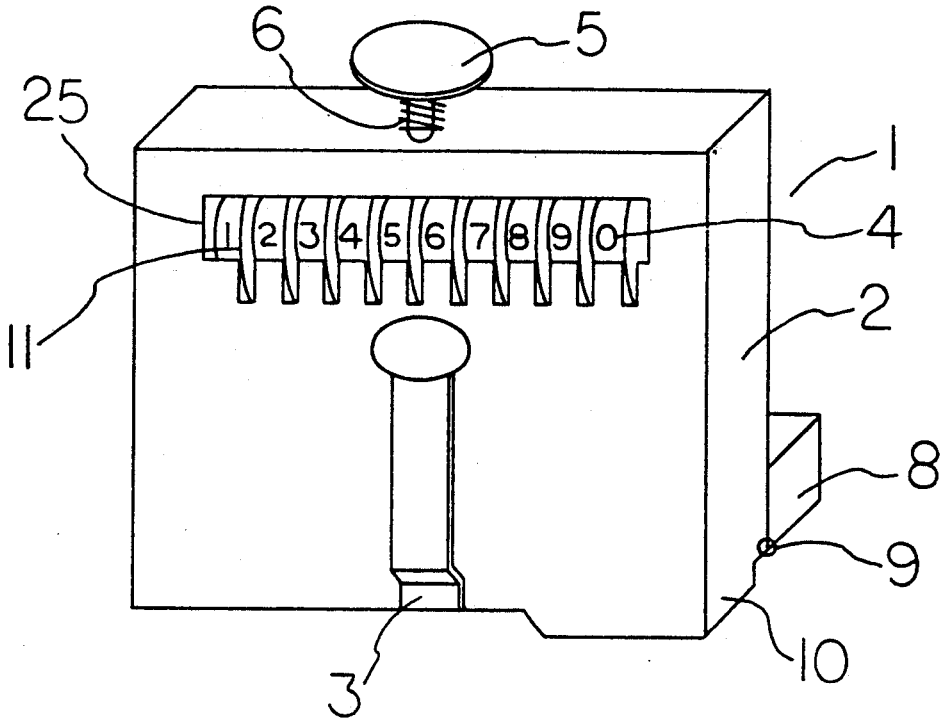
FIG. 1 is an isometric view of the front of the invention.

Referring now to FIG. 1, a personal check amount stamp, referred to generally by the reference numeral 1, is made of suitable material, and comprises an outer enclosure 2, this outer enclosure 2 having a supporting clip 3, and this supporting clip 3 providing means for clipping the outer enclosure onto a personal check book. Outer enclosure 2 having a viewing opening 25 in its upper frontal section, and this viewing opening 25 exposing ten individual digits 4, and these ten individual digits 4 being controlled by ten individual thumb wheels 11, thereby providing positioning means for each of the ten digits 4 in viewing opening 25.

Still referring to FIG. 1, an actuator knob 5, located at the top center section of enclosure 2, having a compression spring 6, and compression spring 6 holding knob 5 in its extended uppermost position.

Figure 3:
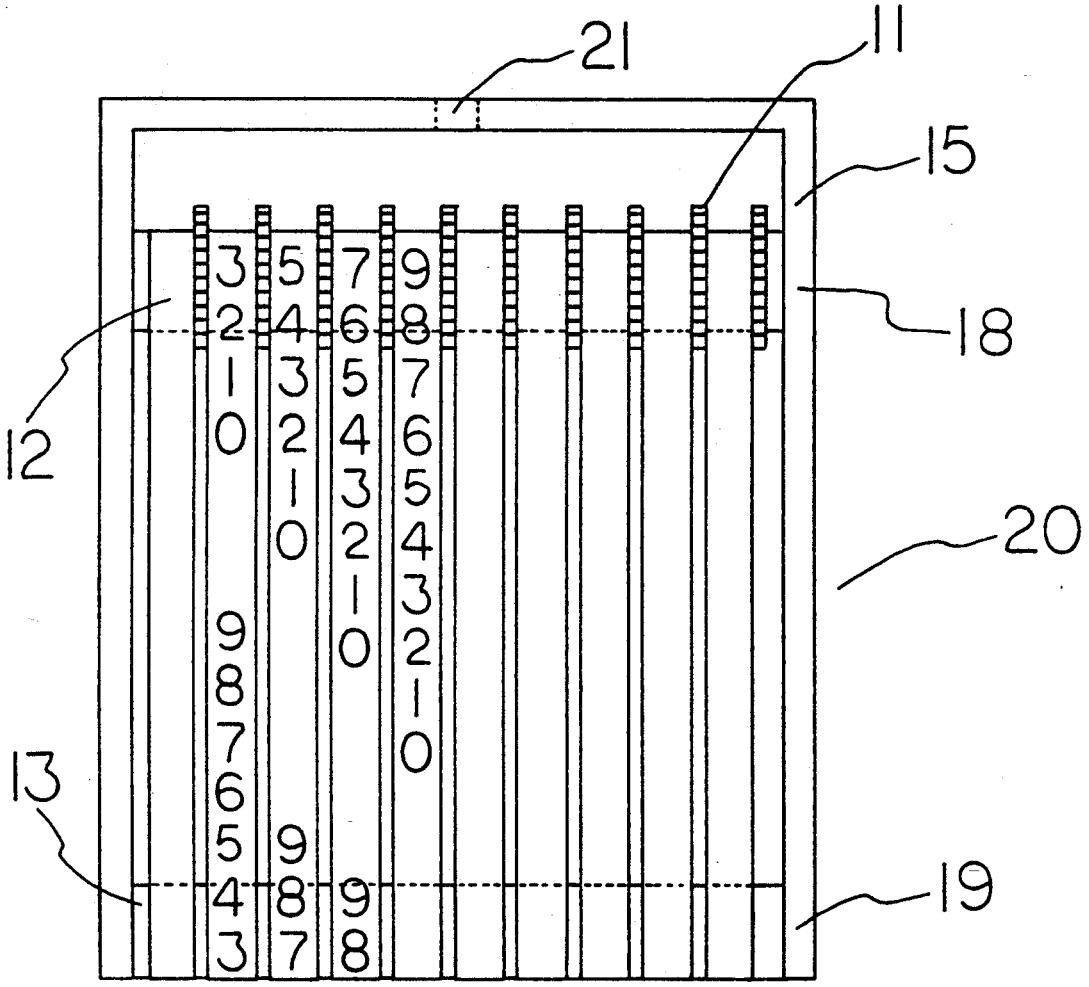
FIG. 3 is a front plan view of the inner parts of the invention, showing the number belts, and the number locations on the belts.

Now, referring to FIG. 3, we see an inner cage 20, having a supporting framework 15, and inner cage 20 being inserted upward into enclosure 2 of FIG. 1, and inner cage 20 being retained in place by actuator knob 5, and inner cage 20 being held in its uppermost position by spring means 6, thereby allowing inner cage 20 to be extended downwardly, and returned to its upward position, by utilizing actuator knob 5, and compression spring 6, thumb wheels 11 moving downward, and upward, in provided slots 7.

Referring back to FIG. 1, we see an ink pad 8, rotatably affixed onto the bottommost rear peripheral of enclosure 2, and this ink pad 8 being filled with magnetic printing ink, as desired by each using bank, or otherwise. Also, and still referring to FIG. 1 a locating skirt 10 being a part of the bottom of enclosure 2, allows the invention to be located onto the corner of the check to be written, assuring that the required check amount being printed in the correct location on the check form.

Figure 2:
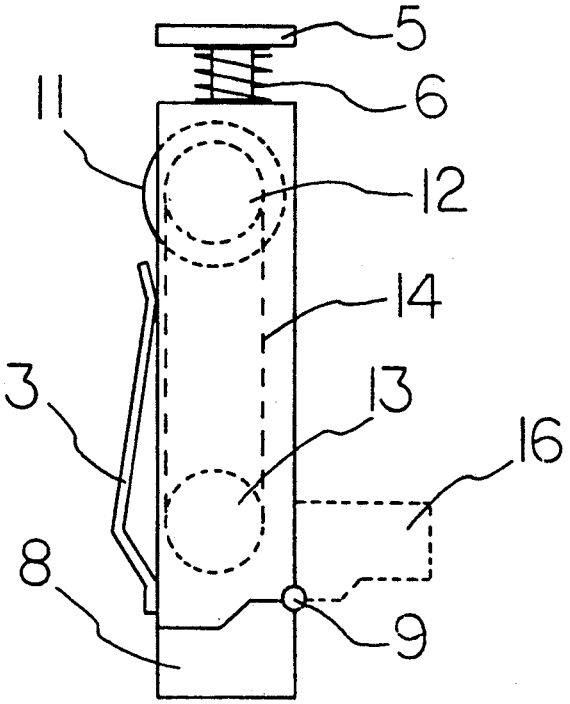
FIG. 2 is a side, view of the invention, showing various parts in dotted lines.

Referring now to FIG. 2, we see the side of the outer enclosure 2, and the inner cage 20 having been inserted inside outer enclosure 2, and inner cage 20 being supported in place by actuator knob 5, and compression spring 6. Now, in dotted form, a series of 10 number strips 14 are rotatably affixed onto a series of wheels, top wheels 12, and bottom wheels 13, thusly allowing number strips 14 to be positioned on top wheels 12, and bottom wheels 13, as desired, using thumb wheels 11, to form number combinations to be printed on check forms, using desired numbers 4, imprinted on number strips 14, number strips 14 being rotated on wheels 12, and 13, and wheels 12, and 13 being supported by a top axle 18, and a bottom axle 19, more easily seen in FIG. 3. Also referring to FIG. 3, we see ink pad 8 being retracted to its rearward position 16, and ink pad 8 being rotatably affixed to outer enclosure 2 by a two position spring loaded hinge 9, allowing actuator 5, actuator 5 being affixed into receiving hole 21 of inner cage 20, to be pushed downward through a hole in outer enclosure 2, to print the desired number combination onto a check form, and compression spring 6 retracting inner cage 20 to its non-print position when printing has been accomplished.

Accordingly, a very unique, attractive, convenient method and apparatus are provided for printing the exact amount of a check onto the check form in at least three locations on the check form, thereby insuring the check writer that the bank will not make a mistake on the check amount, and, relieving the bank of the time consuming duty of comparing the check amounts on the check, and printing the required check amount in the lower right hand corner of the check form, to be read by the computers used in the bank.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A personal check amount stamping device providing means for an individual to view, and at the same time, print the exact amount of a check being written on a check form, comprising:

a more or less rectangular enclosure having a top surface, a frontal surface, a rear surface, a left side surface, and a right side surface, and not having a bottom surface, and having entry to its inner area at its bottom, said top surface having an access hole located centrally, an ink pad, said ink pad being filled with non-magnetic, computer readable ink, and hingedly affixed onto said rear portion of said enclosure at its lowermost edge, said hinge providing 180 degree rotatable retraction of said ink pad, a skirt protruding a distance downward from the lower right peripheral of said frontal portion, said skirt beginning at the right lower corner of said frontal portion of said enclosure, and continuing a distance to the left on said frontal portion, and said skirt also extending a distance along the lower peripheral of said right side portion of said enclosure, thereby providing locating means for said stamping device, onto said check form, a more or less rectangular viewing opening in the front upper section of said frontal portion of said enclosure, said viewing opening having a plurality of equidistant located slots extending downwardly a distance below said viewing opening, and said slots being a part of said viewing opening at their upper peripheral, one said slot for each digit of a number to be printed onto said check form, an inner printing cage assembly, said assembly being inserted into said enclosure through said bottom of said enclosure, and being held in place by a spring loaded actuator, said actuator being a removeable part of said cage assembly, said actuator extending upward through said hole in said top portion of said enclosure, and said actuator being held in its upper position by a spring, said spring being captured between the upper surface of said top portion of said enclosure, and the underside of the top of said actuator, and said inner cage assembly also comprising:

a framework, and said framework providing supporting means for two spaced axles, a top axle, and a bottom axle, each said axle providing turnable, supporting means for a plurality of wheels on said top axle mating with a plurality of wheels on said bottom axle, to form a plurality of sets one set for each digit to be printed, and said sets of wheels providing mounting means for a plurality of adjustable, endless, rubber number strips to be affixed around said set of wheels, one said number strip for each said set of wheels, and each said number strip having at least two sets of numbers affixed onto its outer surface in a manner, and location to provide viewing through said viewing opening, and printing a same digit on said check form in a simultaneous manner, said numbers being individually settable by a set of thumb wheels, one said thumb wheel for each said number strip, and, said thumb wheels being supported on said top axle, and said thumb wheels protruding outward a distance through said slots in said frontal portion of said enclosure, and each said thumb wheel being attached onto the one side of each said wheel, thereby providing said setability of each said wheel, and therefore, each said number on each said number strip, said frontal surface also having a clip affixed at its bottom center peripheral, said clip extending upward a distance to provide clipping means for said enclosure.

2. A personal check amount stamping device of claim 1 having a non-printing setting on each said number strip.

* * * * *